United States Patent [19]

Morris

[11] Patent Number: 4,804,102

[45] Date of Patent: Feb. 14, 1989

[54] BUTTER CONTAINER

[76] Inventor: Cynthia Morris, 5557 Foland Rd., Paradise, Calif. 95969

[21] Appl. No.: 122,389

[22] Filed: Nov. 19, 1987

[51] Int. Cl.[4] ..... B65D 83/00

[52] U.S. Cl. ..... 220/93; 220/355

[58] Field of Search ..... 220/93, 355

[56] References Cited

U.S. PATENT DOCUMENTS

| | | | |
|---|---|---|---|
| 1,838,390 | 12/1931 | Goosmann | 220/93 X |
| 2,519,271 | 8/1950 | Miller | 220/93 X |
| 2,572,960 | 10/1951 | Steans | 220/93 X |
| 3,342,609 | 9/1967 | Bank et al. | 220/93 X |
| 3,481,458 | 12/1969 | Mayeaux | 220/93 X |
| 3,722,731 | 3/1973 | McCormick et al. | 220/355 X |
| 3,924,774 | 12/1975 | Donnelly | 220/93 |

*Primary Examiner*—Steven M. Pollard
*Attorney, Agent, or Firm*—Leon Gilden

[57] ABSTRACT

A plastic container is designed to hold a conventional one quarter pound stick of butter. The butter may be removed from its commerical packaging and inserted into the container for storage. The container includes a slidably movable base which can be utilized to eject the stick of butter from the container in a selective manner, and measurement marks are provided along the container to allow a user to determine the amount of butter sticking out of the container. A cap member is used to reinsert the butter into the container and to effectively seal it until further use.

1 Claim, 3 Drawing Sheets

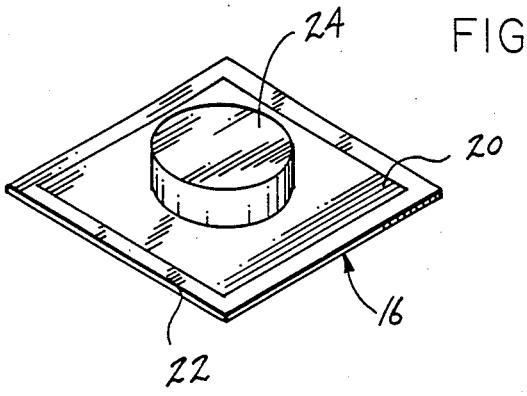
FIG 2
FIG 3
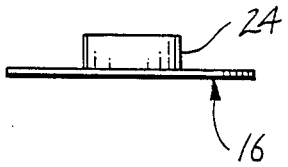
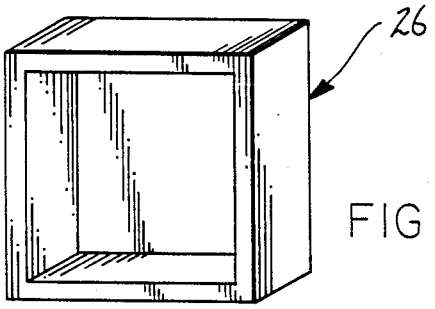
FIG 4

BUTTER CONTAINER

BACKGROUND OF THE INVENTION

1. Field of the Invention

The present invention relates to food containers, and more particularly pertains to a new and improved container for holding conventional quarter pound sticks of butter.

2. Description of the Prior Art

As is well known in the art, butter is typically sold in one pound paper containers with the butter contained therein being individually wrapped in paper in quarter pound increments. when utilizing these individual quarter pound sticks of butter, a user normally peels the paper partially away to expose the butter and a desired amount can then be removed from the stick as desired. However, it is often inconvenient to utilize butter in this manner, and many individuals choose to completely unpackage the butter and to place the same on a plate to facilitate easier access thereto. Again, however, it can be appreciated that the use of butter in various situations can still be complicated—especially when applying butter to ears of corn. More particularly, butter tends to fall off of a knife during its application to an ear of corn, and sometimes individuals find it more convenient to leave the butter wrapped in its paper package when applying the same to the corn. In this regard, the butter can be partly unwrapped and the stick can be directly applied to the ear of corn to thus eliminate the problem of having the butter fall off of a knife. This manner of applying butter is obviously messy and often results in the paper becoming soiled and greasy. During a rewrapping of the butter, the soiled paper frequently has to be discarded or else a refrigerator or some other container may become substantially soiled. As such, there would appear to be a need for some type of container which would allow for an easy and clean storage of a stick of butter, while still permitting the use of a knife to remove selective chunks of butter as desired while also facilitating the application of the butter to an ear of corn in the aforedescribed manner. In this connection, the present invention substantially addresses this need.

SUMMARY OF THE INVENTION

In view of the foregoing disadvantages inherent in the known types of butter containers now present in the prior art, the present invention provides an improved butter container wherein the same facilitates an easy and clean storage of a conventional stick of butter, while also permitting the butter to be selectively meansured and cut from the stick as desired. As such, the general purpose of the present invention, which will be described subsequently in greater detail, is to provide a new and improved butter container which has all the advantages of the prior art butter containers and none of the disadvantages.

To attain this, the present invention comprises a rectangularly shaped, elongated plastic container into which a conventional quarter pound stick of butter can be slidably positined after its covering paper has been removed. The transparent container includes a removable cap and a slidably movable bottom portion. The bottom portion is movable within an interior portion of the container so as to effect an ejectment of the butter stick therefrom, while measurement gradients along the container permit an individual to determine the amount of butter sticking out of the container, as well as the amount still remaining therein. The design of the container also permits its use as a holder for the butter stick while the butter is being applied along an ear of corn. As such, there is no need to cut a chunk of butter from the stick prior to its applicationto an ear of corn. The cap is utilized to reinsert the butter stick into the container.

There has thus been outlines, rather broadly, the more important features of the invention in order that the detailed description thereof that follows may be better understood, and in order that the present contribution to the art may be better appreciated. There are, of course, additional features of he invention that will be described hereinafter and which will form the subject matter of the claims appended hereto. In this respect, before explaining at least one embodiment of the invention in detail, it is to be understood that the inventionis not limited in its application to the details of construction and to the arrangements of the components set forth in the following description or illustrated in the drawings. The invention is capable of other embodiments and of being practiced and carried out in various ways. Also, it is to be understood that the phraseology and terminology emloyed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved butter container which has all the advantages of the prior art butter containers and none of the disadvantges.

It is another object of the present invention to provide a new and improved butter container which may be easily and efficiently manufactured and marketed.

It is a further object of the present invention to provide a new and improved butter container which is of a durable and reliable construction.

An even further object of the present invention is to provide a new and improved butter container which is susceptible of a low cost of manufacture with regard to both materials and labor, and which accordingly is then susceptible of low prices of sale to the consuming public, thereby making such butter containers economically available to the buying public.

Still yet another object of the present invention is to provide a new and improved butter container which provides in the apparatuses and methods of the prior art some of the advantages thereof, while simultaneously overcoming some of the disadvantages normally associated therewith.

Still another object of the present invention is to provide a new and improved butter container which provides for an easy and clean storage of a conventional quarter pound section of butter.

Yet another object of the present invention is to provide a new and improved butter container which effectively permits a measured use of a conventional stick of butter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of a bottom movable plate forming a part of the container.

FIG. 3 is a side elevational view of the plate shown in FIG. 2.

FIG. 4 is a perspective view of a cap utilized with the container.

DESCRIPTION OF THE PREFERRED EMBODIMENT

Figure 1:
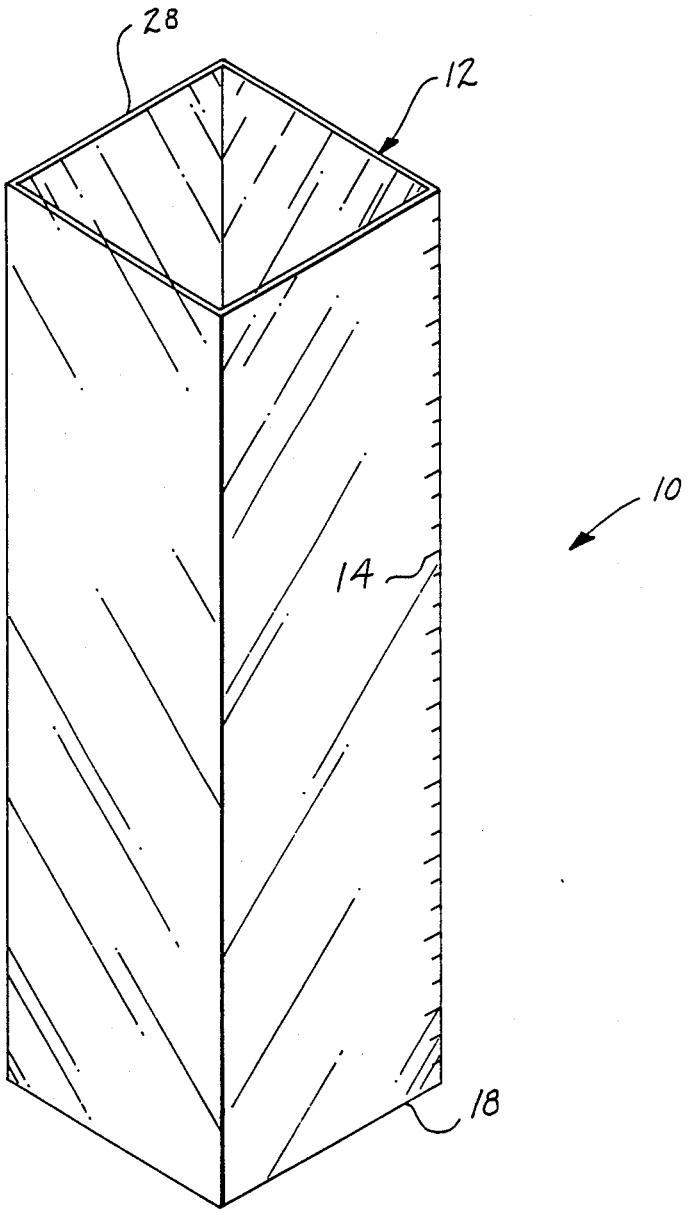
FIG. 1 is a perspective view of the butter container comprising the present invention.

With reference now to the drawings, and in particular to FIG. 1 thereof, a new and improved butter container embodying the principles and concepts of the present invention and generally designated by the reference numeral 10 will be described.

More specifically, it will be noted that the butter container 10 essentially comprises a rectangularly shaped, elongated clear plastic container 12. The clear container 12 could be manufactured from any known translucent or transparent plastic, such as lucite or the like, although it is within the intent and purview of the invention to manufacture the container from any conveivable rigid material. As such, all such types of materials from which the container 12 could be manufactured are intended to be within the scope of the claims appended hereto.

As further illustrated in FIG. 1, the container 12 is desirably shaped to accommodate the close fitting slidable retention of a conventional quarter pound stick of butter. At least one edge of the container 12 may include a plurality of measurement markings 14, and such markings could indicate tablespoons, teaspoons, or any other desired measurement quantity. Due to the clear constructionof the container 12, the retained butter can be viewed throughthe sidewalls thereof to thus allow a determination of the amount of butter retained within the container, as well as the amount of butter which is selectively ejected therefrom.

Figure 5:
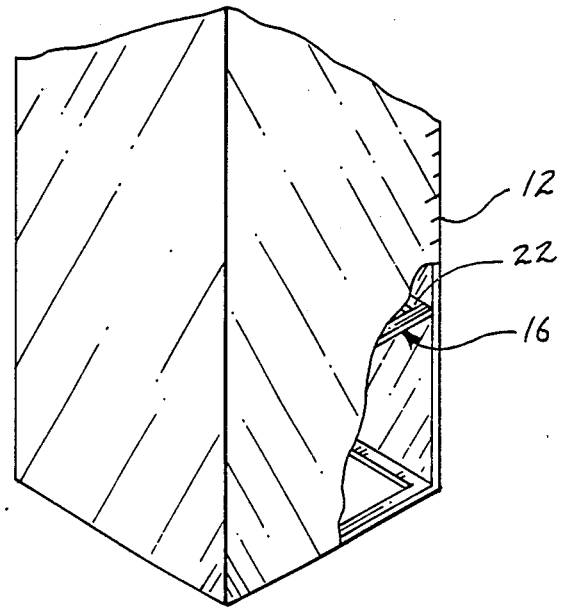
FIG. 5 is a partial perspective view of the container illustrating a use thereof.

FIGS. 2, 3 and 5 illustrate a bottom plate 16 which is slidably retained inone end 18 of the container 12. The rectangularly shaped plate 16 is formed of a rigid rectangularly shaped member 20 haing a peripheral rubber ege portion 22. The rubber edge 22 effects a substantially tight seal between the peripheral edge of the plate 20 and an interior portion of the container 12, while a slidable movement of the plate 16 is permitted as desired. More particularly, the plate 20 may include an outward extension 24 fixedly secured thereto,and this extension is designed to receive the finger of a user. In this regard, a user can push against the extension 24 so as to effect a slidable movement of the plate 16 within the container 12, and it can be appreciated that this slidable movement will effect the desired ejectment of the retained butter from the container. As such, the extension 24 is positioned on a side of the plate 16 which is opposed to the butter contacting surface thereof.

FIG. 4 of the drawings illustrates a cap 26 which is designed to be removably positioned in a tight fitlting manner over an opposed end 28 of the container 12. The cap 26 completes the sealed retention of the butter within the container 12, and is also utilized to push the butter stick back into the container after a usage of the butter has been completed.

As to the manner of usage and operation of the present invention, the same should be apparent from the above description. As such, no further discussion thereof will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new and improved butter container comprising:

housing means including planar side walls for holding a portion of butter;

slidably movable floor means positionable in one end of said housing means, said floor means being slidably movable within an interior portio of said housing means to effect an ejectment of said portion of butter therefrom; and cap means selectively sealingly positionable over a remaining end of said housing means, and wherein said housing means is formed from a clear plastic-like rigid material to thus facilitate a viewing of said portion of said butter contained therein, and further including measurement gradients positioned along an exterior surface of said housing means, and wherein said floor means including a peripheral rubber edge to effect a slidably movable seal between said interior portion of said housing means and said floor means, and wherein said floor means further includes a finger engaging extension to facilitate a movement of said floor means by a user, and wherein said cap means is slidably movable along an exterior surface of said housing means when positioned thereover to form an air tight compartment within said housing means in cooperation with said floor means.

* * * * *